United States Patent [19]

Montesi

[11] 4,276,657

[45] Jul. 7, 1981

[54] ACCESSORY TO HARD HAT ATTACHING MEANS

[75] Inventor: Edward M. Montesi, Barrington, R.I.

[73] Assignee: Norton Company, Worcester, Mass.

[21] Appl. No.: 124,119

[22] Filed: Feb. 25, 1980

[51] Int. Cl.[3] ..... A44B 21/00; A61F 9/02

[52] U.S. Cl. ..... 2/422; 2/10

[58] Field of Search ..... 2/10, 424, 8, 422; 24/255 R, 255 BS, 255 SL, 79, 3 R

[56] References Cited

U.S. PATENT DOCUMENTS

| | | | |
|---|---|---|---|
| 2,733,492 | 2/1956 | Copell | 24/255 R |
| 3,703,750 | 11/1972 | Irwin, Jr. | 2/10 X |
| 3,779,496 | 12/1973 | Welles | 24/255 BS X |
| 3,983,602 | 10/1976 | Barry | 24/3 R X |
| 4,193,133 | 3/1980 | Laibach et al. | 2/10 |

*Primary Examiner*—Peter P. Nerbun

*Attorney, Agent, or Firm*—Walter Fred

[57] ABSTRACT

Protective unit (10) including a hard hat (12) with a lower rim or flange (12*c*), an accessory such as goggles (20), a goggle or accessory band or cord (22) attached to a plurality of accessory band attaching and retaining clips (30) attached to the lower rim of the hard hat. Each clip 30 has a slot of special configuration adapted to accept at least one and preferably a plurality of rims or flanges (12*c*) of different configuration (60, 70, 80 and 90), a substantially rigid stationary portion (32) and an opposing resilient clamping portion (42) for clamping engagement with opposite sides of the rim (12*c*), an opening (56) adapted with an expandable side passage or entrance to receive the band without threading therethrough or detaching it from the accessory and latching means (52) (54) (57) (58) latched to prevent escape of the band and unlatched to insert and remove the band (22).

12 Claims, 7 Drawing Figures

FIG. 1
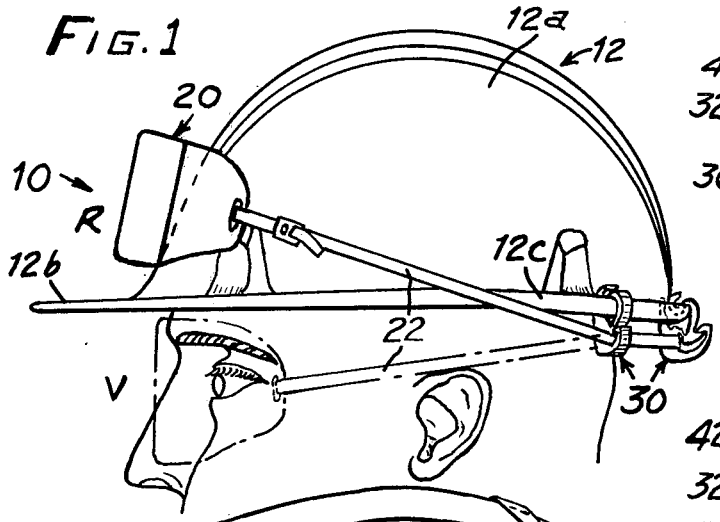
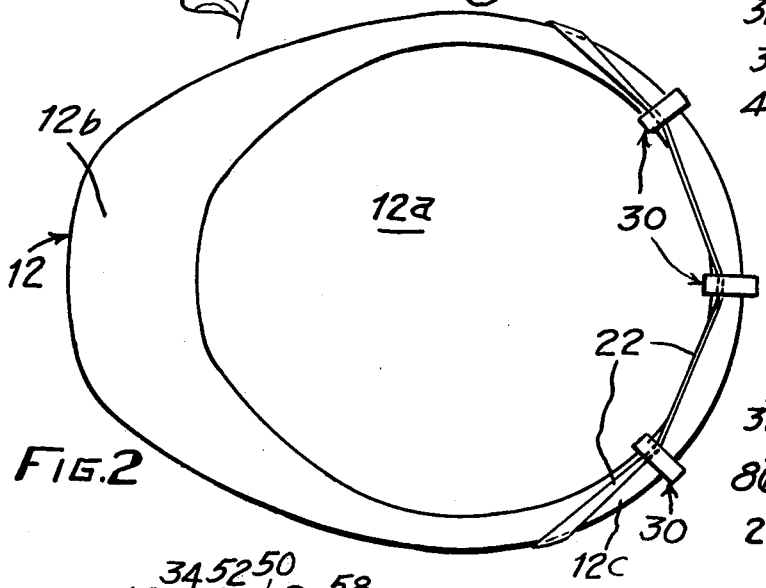
FIG. 2
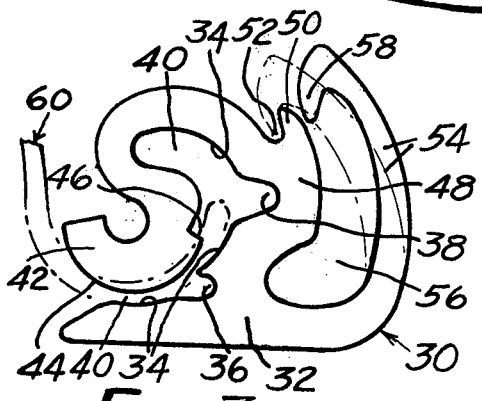
FIG. 3
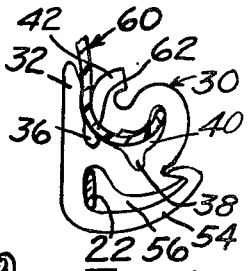
FIG. 4
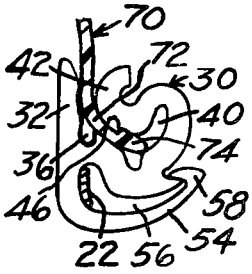
FIG. 5
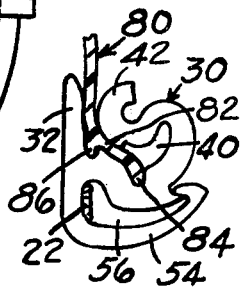
FIG. 6
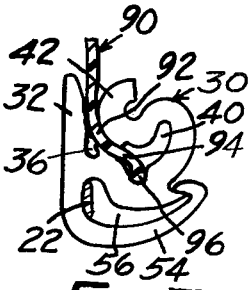
FIG. 7

ACCESSORY TO HARD HAT ATTACHING MEANS

TECHNICAL DISCLOSURE

The invention relates to means for attaching and maintaining an accessory attached to a safety hard hat. Particularly the invention concerns resilient plastic clips adapted to fit differently shaped lower rims, flanges, or gutters found on hard hats, to attach goggles and band thereto without threading and maintaining the goggle band attached during movement of the goggles between protective and non-protective positions.

BACKGROUND OF THE INVENTION

Accessory band attaching and retaining means, such as elongated channel members and tubular spring clips adapted to engage the lower edge or lip of a particular hard hat are known. However, they are usually associated with a tube through which the tie, cord or elastic band of an accessory such as goggles must be threaded and retained. The channel and/or tube members extend continuously over the greater back half of the lower edge and in some instances are attached to and retained to the hard hat by additional fastening means which encircle the hard hat. Unlike the applicant's device disclosed hereinbelow, they usually consist of a greater number of parts, require more material, are more costly, will fit only the specific lower rim contour of a particular hard hat and the band must be threaded through relatively long tube or disconnected from the accessory or goggles.

BRIEF SUMMARY OF THE INVENTION

Molded plastic clips are disclosed for attaching accessories to hard hats. Each clip comprises a rigid stationary portion, and an opposing resilient clamping portion including an adjoining curved slot of special shape for receiving and clamping engagement with a plurality of differently contoured lower peripheral rim portions associated with safety hard hats to which additional protective accessories such as goggles including an elastic strap, band or cord are attached. The plastic clips are spaced along the rear or back half portion of the lower rim and back, has an accessory band receiving and retaining guideway, passage or opening into which a continuous band connected to opposite sides of the accessory or goggles may be inserted, and retained to the hard hat.

Additionally, the band receiving and retaining opening may have either a narrow side entrance, a normally resiliently closed but openable side entrance or a normally open but latched closed side entrance.

The normally open and latched entrance comprises latching means including a catch and a resilient latch arm and head adjoining the band receiving and retaining opening adapted to be opened for inserting and removing the band and snapped closed for retaining the band therein.

Also, the specially shaped curved slot is adapted to receive outwardly flaring lower peripheral rim or flange wall portions having a cross sectional shape that is either generally U-shaped, partly U-shaped, semi or partly semi circular, partly circular with an outer thicker lower edge portion with a raised upper surface, partly circular with a downwardly extending inner bead and inclined downwardly to an outer downturned edge, and partly circular and curved downwardly to an outer downturned edge portion.

BRIEF DESCRIPTION OF THE DRAWINGS

FIG. 1 is a side view of the assembled combination of a hard hat, including goggles, and a goggle band in viewing and non-viewing or rest position attached and retained thereon with a plurality of the retaining clips constructed and attached to the rim of a hat in accordance with the invention;

FIG. 2 is a bottom view of the hard hat, goggle band and clip assembly of FIG. 1;

FIG. 3 is an enlarged side view of one of the retaining clips of the invention rotated 90° counter clockwise to another horizontal and useable position on a rim of a hard hat shown in phantom lines;

FIG. 4 is a side view partly in cross-section showing a clip attached to a generally semi circular shape wall of an outwardly extending and upturned lower rim portion of a hard hat;

FIG. 5 is side view partly in cross-section showing a clip of the invention attached to a partly circular shape wall including a relatively thicker outer edge portion with an upwardly raised surface and shoulder of an outwardly and downwardly flaring lower rim portion of another hard hat;

FIG. 6 is another side view partly in cross-sectional showing a clip attached to still another partly circular curved and downardly inclined shaped wall with an inner downwardly projecting bead and an outer downturned edge of an outwardly and downwardly flared lower rim portion of still another hard hat; and FIG. 7 is a side view partly in section showing a clip attached to a partly circular shape wall including an outer downturned lower edge of an outwardly and downwardly flared lower rim portion of still another hard hat.

DETAILED DESCRIPTION OF THE INVENTION

In accordance with the invention, FIGS. 1 and 2 depicts an assembled eye and head protective unit 10. The unit 10 comprises the combination of a conventional safety cap or hard hat 12, another protective accessory such as goggles 20 including elastic band or cord 22 and a plurality of retaining clips 30 for attaching and retaining the goggles 20 and band 22 attached to the safety hard hat 12.

The safety cap or hard hat has a crown portion **12*a* connected to a visor or brim 12*b* and a lower rim, flange, edge or gutter 12*c* with a wall of any of the cross-sectional shapes shown in FIGS. 3 to 7 to which the clips 30** may be attached.

Goggles 20 may be of a conventional or desired type but one preferably of the type which protect the eyes in one way or another.

The band 22 attached to opposite sides of the goggle may be of any conventional elastic or stretchable resilient band, cord, or strap or the like. Preferably the band 22 is a continuous flexible elastic band with means for adjusting the length thereof either on the goggles or on the band.

The resiliency, stretchability and recovery of the elastic band should be sufficient to permit shifting of the goggles from a non viewing resting position R against the crown **12*a* above the brim 12*b*** and forwardly beyond the brim and back to a viewing position V against the facial area about the eyes of the wearer as shown in FIG. 1. Also, the elongated adjustable band or cord 22 may be of any suitable cross sectional shape such as square, rectangular, round, oval, flat and of either solid, hollow or tubular material.

As shown in FIGS. 1 and 2 the elastic band 22 or the like extends through openings in a plurality of the clips 30 angularly spaced about and attached to the rear or back rim portion 12*c* of the hard hat 12. In the goggle resting position R the band 22 extends between and through the clips or retaining members 30 and upwardly over the opposite sides of the lower rim 12 to opposite sides of the goggles. Shifting the goggles to the viewing position V disengages the band or cord 22 from the sides of the rim and position it below the rim.

The clips 30 are preferably injection molded of a resilient nylon plastic material, such as, ZYTEL (T.M. of Dupont) or an equivalent material. However, it may be constructed of other plastics, reinforced plastics and conventional resilient or spring like metals.

Typically a band retaining clip 30 comprises a substantially rigid side portion 32 having an inner concave surface 34 of generally semi circular shape interrupted by a pair of recesses and recessed surfaces 36 and 38 and adapted to engage the generally convex surface of the wall of a lower rim 12*c* of a hard hat 12.

The interrupted semi circular surface 34 and recessed surfaces 36 and 38 also define one side of an adjoining rim receiving curved slot 40 of generally arcuate or semi circular shape into which hard hat rims of various contours may be inserted and clampingly engaged.

Opposite and spaced from the more rigid portion 32 is a resilient clamping portion 42 of generally S-shape which loops around the adjoining semi-circular rim receiving slot 40. An inner clamping loop portion of the S-shaped resilient clamping portion 42 has generally semi circular convex surface 44 adjoining the entrance to the slot 40 and spaced from the opposing interrupted concave surface 34 of portion 32. Convex surface 44 is also interrupted by an intermediate notch including a recessed surface and shoulder 46 from which it continues around to a reversed curved narrow portion and inside surface of the outer loop of the S-shape clamping portion around the closed end of the slot 40 to a connection with the concave surface 34. The resilient clamping portion 42 including the interrupted convex surface 44 and shoulder surface 46 are adapted to engage and clamp against the generally outer concave surface and shoulder surface portions of the wall of the lower rim of a hard hat.

It can be seen in FIG. 3 that the tapered end of the stationary portion 32 and the convex surface 44 of the inner loop of portion 42 provides the rim receiving slot with a single enlarged entrance that tapers or flares outwardly from an inner narrower curved portion of the expandable slot 40 to free ends of portions 32 and 42.

As constructed the initial unexpanded width of the narrower portion of the slot 40 between surfaces 34 and 44 adjacent the entrance is substantially less than the wall thickness of the lower rim insertable therein. Thus, the insertion of a thicker rim forces the resilient S-shape clamping portion 42 to flex and move away or swing outwardly relative to the more rigid portion 32. As a result of the displacement and the resiliency of the material a sufficient amount of an opposing spring or resilient force is created to maintain a rim of a hard hat clamped between the surfaces 34 and 44 of the opposing portions 32 and 42.

Preferably, latching means are provided on the clip 30 for opening and closing an inlet, outlet or side passage through which a goggle band or cord may be inserted or removed from the cord receiving opening in the clip.

The latching means is supported by an intermediate latch retaining portion 48 adjoining and connected to the end portion of the outer loop of the S-shaped clamping portion 42 and intermediate portion of the more rigid portion 32. Projecting from the latch retaining portion 48 is a catch portion 50 and an adjoining latch receiving recess 52.

Spaced from the latch retaining portion 48 is an elongated arcuately curved resilient latch arm portion 54 integrally connected at one end to the opposite end portion of the more rigid portion 32. The resilient latch arm 54 extends from the portion 32 and about one side of a band or cord receiving and retaining opening 56 to an inwardly projecting latch head portion 58 at the opposite free end of the latch arm portion 54 adjacent a side passage to opening 56.

In the enlarged version of the clip 30 shown in FIG. 3 the latch head portion 58 is shown in an initial open or unlatched position relatively close to and if desired may engage the catch portion 50 to close the side passage. When a band or cord of greater thickness is inserted between the catch 50 and latch head 58 it forces the head and latch arm 54 outwardly to open the side passage and thus creates an opposing resilient force which returns them to the initial position once the band enters the larger opening 56. The band is retained in the opening 56 and prevented from escaping therefrom by the projecting latch head 58.

However, to prevent the possibility of the band 20 escaping therefrom, pressure is applied against the curved resilient arm 54 by manually squeezing the clip between the finger and thumb until the latch head 58 rides over the catch 50 and snaps into the recess 52 to a latched position shown in FIGS. 4–7.

In the latched position the opposing resilient force created by flexing the arm maintains the inner inclined surface of the latch head 58 in engagement with the similarly inner inclined surface of the catch 50. Also, the catch 50 enters and becomes locked in a recess between the latch head 58 and latch arm 54.

Unlatching is accomplished by placing ones thumb or finger against portion 32 and forcefully inserting another finger or thumb in the space between the outer loop portion of the S-shaped portion 42 and the latch head 58. Then applying in opposite force or pulling causes the latch head 58 to ride up and over the catch 50 to the initial unlatched position.

Thus, it is obvious that a goggle, shield, respirator or some other accessory band or cord can but need not be threaded through the opening 56 of each clip 30 and the accessory band can be easily inserted and removed without detaching the accessory therefrom.

Referring to FIGS. 4–7 wherein the universal accessory band attaching and retaining clips 30 are shown attached to lower rim or flange portions of various cross sectional shapes typically found on commercially available safety caps or hard hats.

In FIG. 4 the hard hat has a lower rim or flange 60 with a wall portion 62 of generally semi circular or U-shape and an upturned outer edge portion 64 which together forms a rain gutter that slopes forwardly to the visor or brim as shown in FIG. 1.

In the generally vertical position shown in FIG. 4 the semi-circular flange 60 extends substantially the entire length or depth of the slot 40. However, the clip 30 may be positioned at different angles by pivoting it outwardly from the vertical position shown in FIG. 4 or pivoting it inwardly from the horizontal position shown in FIG. 3. In other than the vertical position shown in FIG. 4 the amount flange 60 extends into the slot 40 will be less and vary accordingly.

Also, it is possible to attach the clip 30 to a wall of a flange or rim that is partly circular and of less than semi or half circular shape. For example, the clip 30 could still be attached and forcefully clamped onto a wall portion of an outwardly curved rim or flange having a bend or angular length as little as ⅛ or 45° of a complete circle or ¼ of the semi or half circular flange 60.

Further, the wall need not be of uniform thickness nor concentric. The flange or rim may have a straight bottom portion extending between curved portions or the upturned edge portion may be shorter and straight instead of curved as shown in FIG. 4.

Another lower rim or flange 70 of different configuration to which a clip 30 is attached is shown in FIG. 5. The outwardly flaring flange 70 has an outwardly and downwardly extending curved wall portion 72 of about ⅛ or 45° bend or annular length of a circle including a concave surface extending to a thicker outer edge portion 74 with an inner shoulder extending upwardly to an upper raised or top surface. An inner convex surface of the flange 70 is clampingly engaged by the interrupted concave surface 34 of portion 32 while its opposite concave surface of less angular length, the raised surface and shoulder are resiliently engaged by the interrupted convex surface 44 and shoulder 46 of the inner loop of the S-shape clamping portion 42.

Still another flange 80 of different shape and to which a clip 30 is attached is shown in FIG. 6. Flange 80 has a wall portion 82 with an approximate ⅛ or 45° bend clamped between portion 32 and 42 of clip 30 and extending outwardly to an inclined portion 82 extending outwardly and downwardly to a downturned outer edge portion 84 projecting into the outer longer or deeper recess 38 of clip 30. Also, extending downwardly from the outer convex surface of the ⅛ bend portion 82 is an inner short bead 86 which projects into the inner, shorter or shallower recess 36 of the clip 30.

Lastly, FIG. 7 depicts another flange or rim 90 of a still another configuration to which a clip 30 is shown attached thereto. The lower flange or rim 90 has a similar outwardly curved portion 92 with a bend slightly less than or approximately the ⅛ or 45° bend of flange 80. The portion 92 extends downward to what appears to be an outer oppositely or reversed curved portion 94 extending downwardly to a lower outer downturned edge portion 96 projecting into the recess 38 of the clip 30.

A typical clip 30 of the invention is preferably made by injection molding a suitable plastic material to the desired form and size of about 1" (2.54 cm) long, about 1" (2.54 cm) wide and about 5/16" (7.87 mm) thick. However, the clip 30 may be extruded to form and cut to the desired thickness or length in the known manner. Also, the clip may be longer or shorter in length.

Application of the clip 30 to angularly spaced portions of the hard hat rim of various shapes is simply carried out by aligning the entrance of the slot 40 with the outer edge of the flange or rim and forcing it over and into resilient frictional clamping engagement therewith.

Normally, three clips 30 spaced apart along the rear portion of the rim of the hat is sufficient. However, an additional number of them may be applied if desired or required.

The goggle or other accessory is placed against hard hat crown 12*a* and the stop or band 22 stretched rearwardly and inserted through the side passage between the catch 50 and latch head 58 and into the opening 56 of each clip 30.

Thereafter, the latch means either may be left open but is preferably latched closed to prevent any possible escape of band from the opening 56 and clip 30.

In use the relatively small amount of resilient force of the engaging accessory band 22 serially passing through the openings 56 pulls generally against the more resistant rigid portion 32 in frictional clamping and abutting engagement with the inner convex surface of the rim or flange. Hence, the frictional clamping engagement and interlocking effect of the rim with the clip resists relative movement therebetween.

In some instances the slot 40 in each clip 30 and the lower rims of hard hats may or may not be a true semi circular shape with but a single radius of curvature. Therefore the term "generally semi circular" used hereinabove in reference to the slot 40 and the lower rim is meant to include true semi circular, variations of semi circular and curved slots and rims with one or more than one radius of curvature that extend approximately 180° and slots which can accept lower rims having bends or curves extending up to about 180°. Further it is to be understood that for some applications the curved slot 40 need not extend 180° but may extend anywhere up to 180° from the entrance and accept lower rims that are correspondingly less than 180°, equal to or less than the angular depth of the slot in the clip 30.

As many modifications of the invention are possible it is to be understood that the invention is not limited to the specific embodiment disclosed hereinabove but include all modifications and equivalents falling with the scope of the appended claims.

I claim:

1. A resilient clip adapted for attachment to a portion of the lower rim wall of a hard hat and attaching and retaining an accessory band thereto comprising:

a substantially rigid stationary portion extending inwardly from an entrance end portion thereof and adapted to frictionally engage a surface portion of the lower rim wall, a moveable resilient clamping portion situated opposite the stationary portion and which is adapted to engage an opposite surface portion of the lower rim wall, move outwardly, flex and produce a resilient clamping force against a portion of the lower rim wall insertable in between the stationary and moveable resilient portions when the clip is attached to the lower rim of the hard hat, a curved slot including an entrance expandable between the stationary and moveable resilient clamping portions for receiving a portion of the lower rim wall, and a passage extending through the clip adjacent the rigid stationary portion and spaced from the slot and adapted for receiving and retaining the accessory band to the clip.

2. A resilient clip according to claim 1 wherein the stationary portion has a concave surface adapted to frictionally engage a convex surface portion of the lower rim wall.

3. A resilient clip according to claim 2 wherein the moveable resilient clamp portion has a convex surface adapted to engage an opposite concave surface portion of the lower rim wall.

4. A resilient clip according to claim 3 wherein the resilient clamping portion has an outer portion connected relative to the stationary portion and an inner portion extending from the outer portion to an entrance end portion thereof adjacent the entrance to the slot.

5. A resilient clip according to claim 4 wherein the curved slot extends anywhere up to 180° from the entrance and between the concave surface of the stationary portion and convex surface of the moveable clamping portion to a closed end whereby the curved slot is adapted to receive a lower rim wall with a configuration having a bend that extends anywhere up to about 180° or less.

6. A resilient clip according to claim 5 wherein the slot further comprises:

an intermediate recess and surface in the concave surface of the stationary portion situated between the entrance and closed end of the slot whereby the slot is further adapted to receive a lower rim wall of another configuration including a bend extending outwardly and downwardly to a downturned edge portion insertable into the intermediate recess.

7. A resilient clip according to claim 6 wherein the slot further comprises:

an inner recess and recessed surface in the concave surface of the stationary portion situated between the entrance and intermediate recess in the curved slot whereby the slot is further adapted to receive a lower rim of still another configuration having a bend extending outwardly and downwardly to a downturned edge portion insertable into the intermediate slot and a bead projecting from the bend insertable into the inner recess.

8. A resilient clip according to claim 7 wherein the slot further comprises:

a notch including a shoulder in the convex surface of the resilient clamping portion situated between the entrance and closed end of the slot whereby the slot is further adapted to receive a lower rim wall of still another configuration having a bend extending downwardly and outwardly to a thicker outer end portion with a raised surface and inner shoulder insertable into the notch and engageable with the shoulder in the convex surface.

9. A resilient clip according to claim 8 wherein the passage further comprises:

a side entrance through which the accessory band may be passed into and out of the passage without disconnecting the band from the accessory and threading it therethrough.

10. A resilient clip according to claim 8 further comprising:

latching means adjacent the side entrance to the passage for closing off the side entrance and preventing the escape of the accessory band therefrom and openable to insert and remove the band from the passage.

11. A resilient clip according to claim 10 wherein the latching means comprises:

a resilient latch arm portion extending from and an opposite end portion of the stationary portion and about a portion of the passage to a free end thereof adjacent the side entrance, a latching head portion including a catch engaging surface projecting inwardly from the free end of the latch arm portion adjacent the side entrance, and a catch portion including a latching engaging surface projecting from an intermediate portion of the substantially rigid stationary portion extending about on opposite side of the passage to the side entrance whereby applying force against the resilient arm portion causes it to flex and the latch head portion to ride up and over the catch and snap into a latched position to close off the side entrance and applying an opposite force against the latch head portion causes the latch head portion to ride up and over the catch to an unlatched position to open the side entrance.

12. A protective unit including a safety hard hat having a crown portion extending to a lower rim, an accessory engageable in an inoperative rest position with the crown and an accessory band attached to and extending rearwardly from the accessory for connection to the lower rim of the hard hat, wherein the improvement comprises:

a plurality of clips angularly spaced along and attached to the lower rim for attaching and retaining the accessory band thereto and each clip having a substantially rigid stationary portion extending from an entrance end portion thereof and adapted to frictionally engage a surface portion of the lower rim wall, a moveable resilient clamping portion situated opposite the stationary portion and which is adapted to engage an opposite surface portion of the lower rim wall, move outwardly, flex and produce a resilient clamping force against a portion of the lower rim wall insertable in between the stationary and moveable resilient portions when the clip is attached to the rim of the hard hat, a curved slot including an entrance expandable between the stationary and moveable resilient clamping portions for receiving a portion of the lower rim wall, and a passage extending through the clip adjacent the rigid stationary portion and spaced from the slot and adapted for receiving and retaining the accessory band to the clip.

* * * * *